US005988594A

United States Patent [19]

Gill

[11] Patent Number: 5,988,594

[45] Date of Patent: Nov. 23, 1999

[54] HALF SCISSOR JACK STRUCTURE

[75] Inventor: Bryan D. Gill, Newmarket, Canada

[73] Assignee: Ventra Group Inc., Tottenham, Canada

[21] Appl. No.: 08/979,343

[22] Filed: Nov. 26, 1997

Related U.S. Application Data

[63] Continuation of application No. 08/600,011, Feb. 14, 1996, abandoned.

[51] Int. Cl.[6] ..... B66F 3/00

[52] U.S. Cl. ..... 254/126

[58] Field of Search ..... 254/122, 129, 254/126, 88, 7 R, 7 B, 7 C, 8 B, DIG. 1, DIG. 4, 108, 111; 298/903; 52/731.1, 731.7, 731.8

[56] References Cited

U.S. PATENT DOCUMENTS

| | | | |
|---|---|---|---|
| 742,549 | 10/1903 | Zeh et al. | 52/731.2 |
| 824,550 | 6/1906 | Lazerges | 52/731.7 |
| 1,994,015 | 3/1935 | Curran | 254/126 |
| 2,193,424 | 3/1940 | Johnson | 254/DIG. 1 |
| 3,163,925 | 1/1965 | Ulm | 254/111 |
| 3,241,285 | 3/1966 | Baroni | 52/731.7 |
| 3,295,829 | 1/1967 | Tarr | 254/88 |
| 3,461,638 | 8/1969 | Balinski | 52/731.7 |
| 4,266,809 | 5/1981 | Wuerflein | 254/DIG. 1 |
| 4,624,448 | 11/1986 | Lawman et al. | 254/122 |
| 5,046,652 | 9/1991 | Shanok et al. | 248/903 |
| 5,121,897 | 6/1992 | Sofy | 248/903 |
| 5,139,232 | 8/1992 | Bailey | 254/122 |
| 5,199,688 | 4/1993 | Engel | 254/126 |
| 5,275,378 | 1/1994 | Alten | 254/124 |
| 5,348,330 | 9/1994 | Few et al. . | |
| 5,458,315 | 10/1995 | Blatz et al. | 254/88 |
| 5,501,428 | 3/1996 | Garceau . | |

FOREIGN PATENT DOCUMENTS

| | | | |
|---|---|---|---|
| 59820 | 2/1912 | Germany | 52/732.1 |
| 41 26 085 | 2/1993 | Germany . | |
| 1196460 | 6/1970 | United Kingdom | 52/731.1 |
| 1551256 | 8/1979 | United Kingdom | 254/126 |

*Primary Examiner*—Robert C. Watson
*Attorney, Agent, or Firm*—Pillsbury Madison & Sutro LLP

[57] ABSTRACT

A jack configuration, which may be characterized as a half scissor jack, which achieves the objects of simplifying manufacture by reducing component parts and limiting overall size of the jack while providing the requisite load bearing and height variation characteristics appropriate to the intended vehicle lifting and which furthermore reduces the potential for a torsional deflection in the base channel. Torsional deflection is reduced by creating a box section in the base channel, preferably by providing a channel bracket structure that spans the base channel to maintain the spacing of the side walls of that component.

20 Claims, 4 Drawing Sheets

52
14
50
26
28
20
18
24
16
α
12

HALF SCISSOR JACK STRUCTURE

This is a continuation of application Ser. No. 08/600,011, filed on Feb. 14, 1996, which was abandoned upon the filing hereof.

BACKGROUND OF THE INVENTION

1. Field of the Invention

This invention relates to a jack for lifting automobiles and other vehicles. More particularly, the invention relates to an improved construction of a jack to reduce distortion or deflection of the components thereof in use.

2. Description of the Related Art

A portable jack is typically stored in a vehicle to enable the driver to lift a portion of the vehicle to effect emergency repairs, such as change a tire.

A popular jack configuration is known as the pantographic jack. Pantographic jacks typically have four arms hinged in a parallelogram at four joints. One joint is located on a base of the jack, another joint is positioned at a load rest vertically above the base. Two other free floating points are located on a horizontal diagonal at opposite corners of the parallelogram formed by the four arms. When the free floating points are joined together in a horizontal plane for example by means of a drive screw, the arms are extended more vertically to thereby lift the load rest with respect to the base and the vehicle part disposed on the load support. Thus the relative position of the free floating joints is controlled by a drive screw or thread shaft which lengths them together. Typically, one of the free floating joints has a threaded annulus or nut which moves axially along the length of the drive screw in response to rotation of the screw. The other free floating point has a bearing in which the screw turns without changing its axial position with respect to that joint.

Modern automobile design has placed an increasing emphasis on efficient use of space. Thus, jack manufacturers have focused attention on reducing the amount of trunk space required for jack storage. Steps have also been taken to simplify the component parts of the jack and reduce the number of component parts to reduce material and assembly costs and to simplify manufacture.

A so-called Half Scissor Jack has been developed and addresses some of the issues noted above. Typically, a Half Scissor Jack consists of a base, a load rest, a base channel, and a lift channel. These components are usually metal stampings with the base component and the lift component being typically "U"-shaped in cross-section.

The inventor has recognized that when such a Half Scissor Jack is used to raise and support a vehicle, the jack can experience a great deal of torsional deflection through the base channel. This creates the potential for an unstable condition of the jack which can cause the vehicle to fall off the jack.

SUMMARY OF THE INVENTION

The present invention is directed to a unique jack configuration, which may be embodied as a half scissor jack which achieves the objects of simplifying manufacture by reducing component parts and limiting overall size of the jack while providing the requisite load bearing and height variation characteristics appropriate to the intended vehicle lifting and which furthermore reduces the potential for a torsional deflection in the base channel.

The foregoing and other objects of the invention are realized by providing a channel bracket that can act to reinforce the base channel. In accordance with the invention, such reinforcement can be provided by creating a box section in the base channel, in such a manner that does not reduce manufacturability of the jack. In another embodiment, such reinforcement can be provided by mounting a channel bracket to the outside of the base channel.

Thus the objects of the invention are realized by providing a jack comprising a base; a first jack arm having first and second longitudinal ends, the first jack arm being pivotally coupled to the base at the first longitudinal end thereof; and a second jack arm having first and second longitudinal ends. The first longitudinal end of the second jack arm is pivotally coupled to the first jack arm and a load rest is pivotally coupled to the second longitudinal end of the second jack arm. A drive screw is operatively coupled to the first and second jack arms so that rotation of the drive screw relative to the jack arms selectively increases a vertical distance between the load rest and the base. The first jack arm is stamped metal and is of generally U-shape in cross section, having a bottom wall and first and second side walls. A channel bracket structure, which may be in the form of a separately formed channel insert, is secured with respect to the base channel so as to extend at least a substantial portion of a distance between the first and second side walls, thereby to reduce the torsional deflection in the base channel.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
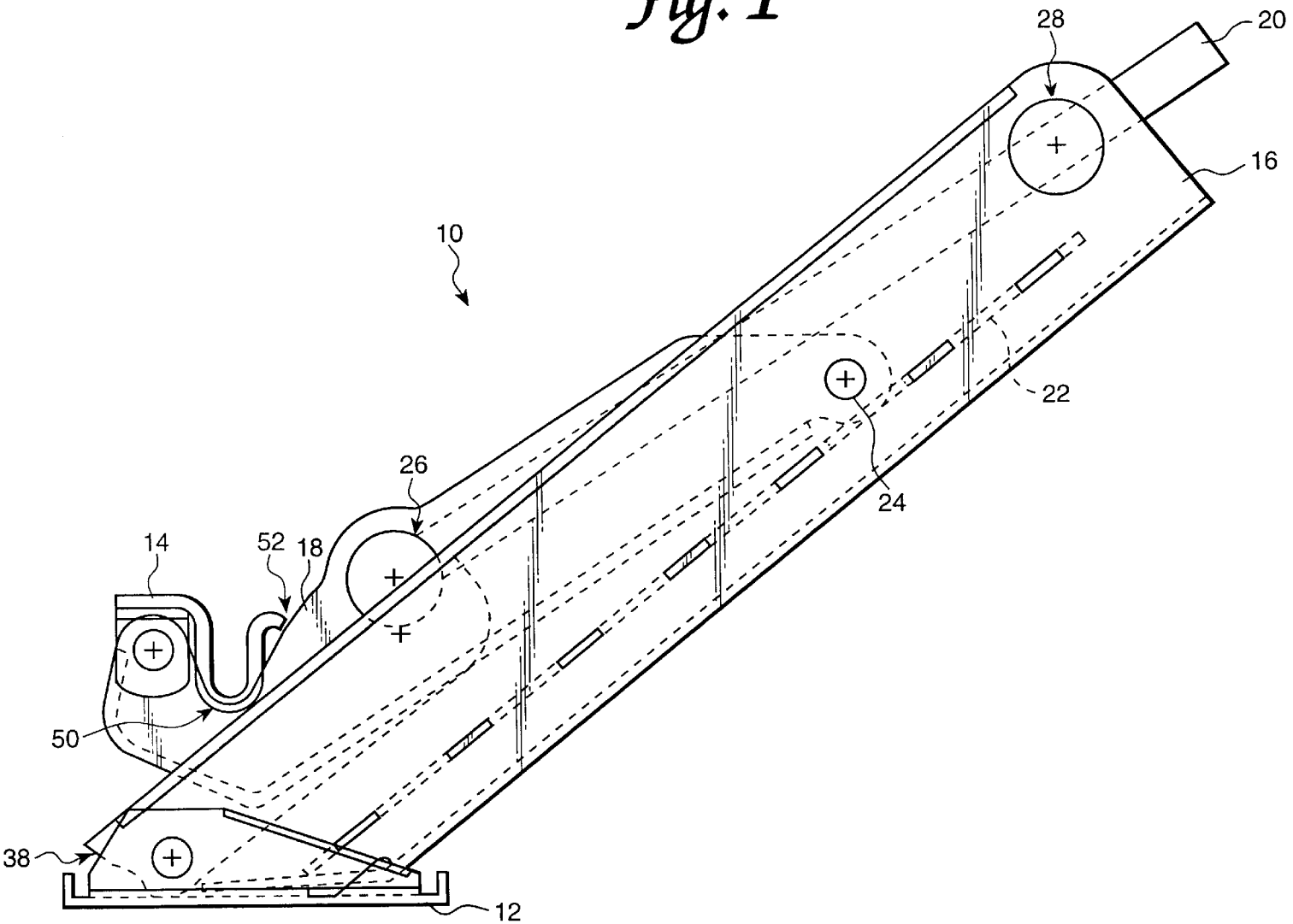
FIG. 1 is a schematic elevational view of a collapsed jack in accordance with the invention.

In general terms, the jack 10 that is the subject of this invention has a base 12 to position the jack on a ground support, a load rest 14 to fit under and to carry and support a vehicle, first and second jack arms 16, 18 pivotally secured to each other and a drive screw 20 for controlling the disposition of the jack arms relative to one another to thereby define the height of the load rest relative to the base.

To reduce torsional deflection in the base channel, in accordance with the invention, a channel bracket 22, 122, 222 has been provided. In the illustrated embodiments, so as to not reduce manufacturability of the jack, either a box section is defined, for example, by adding a bracket 22, 122, which may be in the form of an insert, to the first jack arm or base channel 16, or a bracket 222 is secured to the outside of the base channel 16.

Figure 7:
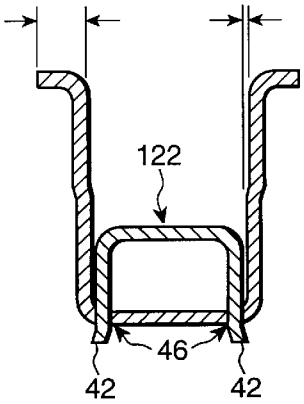
FIG. 7 is a schematic cross sectional view of a base channel, in accordance with another exemplary embodiment of the invention.
Figure 9:
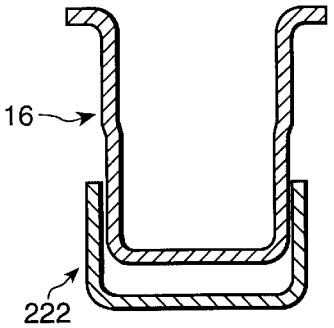
FIG. 9 is a schematic cross sectional view of a base channel, in accordance with another exemplary embodiment of the invention.
Figure 6:
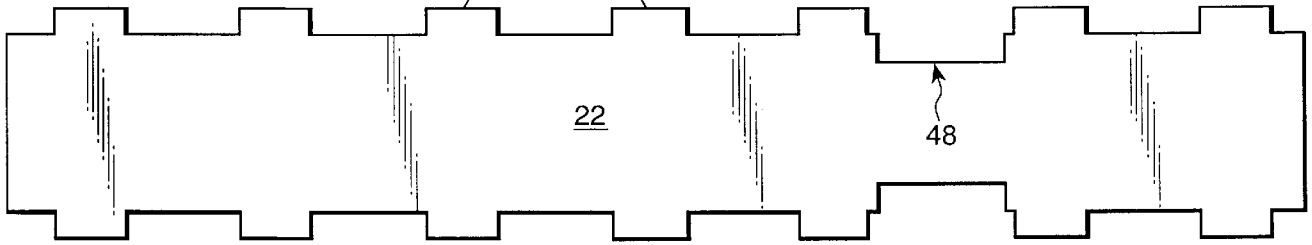
FIG. 6 is a schematic plan view of one embodiment of a channel bracket provided in accordance with the present invention.
Figure 8:
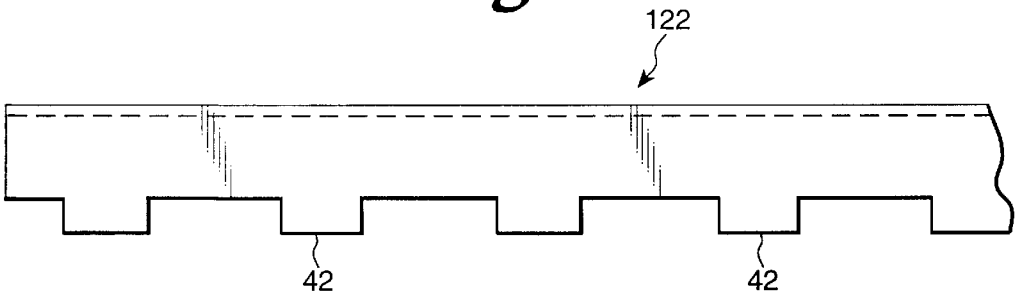
FIG. 8 is a schematic elevational view of the channel bracket of FIG. 7.

As will become apparent below, the bracket does not have to be a flat piece insert 22 as shown in FIGS. 1–6. Indeed, a "U"-shaped channel bracket or insert 122, as shown in FIGS. 7–8, and a "U"-shaped channel bracket 222 as shown in FIG. 9, would also each function to reduce the potential for a torsional deflection in the base channel 16. Moreover, one or more "L"-shaped channel insert(s) (not shown) could be provided to span the base channel to reduce the torsional deflection in the base channel in accordance with the invention.

Furthermore, the bracket structure need not be separately formed. Indeed, a suitable bracket could be defined as an extension of a portion of the base channel that is folded and secured with respect to the remainder of the base channel to provide a box section or to reinforce the remainder of the base channel.

One skilled in this art, upon a review of the embodiments disclosed herein, will recognize that other alternative bracket configurations and mounting orientations could be adopted to realize the objects of the invention.

FIG. 1 illustrates the half scissor jack 10 embodying the invention, in its collapsed or lowered height disposition. The jack has a one-half parallelogram shaped structure made up of a first arm or base channel 16 and a second arm or lift channel 18. The jack has a base 12 pivotally coupled to the first longitudinal end of the base channel 16 to position the jack on a ground support. The first arm and the second arm are pivotally secured together at a first joint 24. In the illustrated embodiment, the pivot joint 24 is spaced from the longitudinal ends of the base channel 16 and is defined at a first longitudinal end of the lift channel 18.

A load rest 14 is provided to fit under and support the vehicle (not shown) during lifting. In the illustrated embodiment, the load rest is pivotally secured to the second longitudinal end of the lift channel 18. The pivot connections between the base and the base channel, between the base channel and the lift channel, and between the lift channel and the load rest are all schematically depicted in the accompanying illustrations because variations therein could be adopted without materially departing from the present invention.

A bearing 26 is pivotally secured, for example via trunion pins and trunion caps (not shown), to the lift channel 18, intermediate the longitudinal ends thereof. In the illustrated embodiment, the bearing 26 is provided intermediate the ends of the lift channel 18, closer to the load rest 14 than to the pivot coupling 24 with the first arm.

A threaded trunion 28 is pivotally secured, for example by trunion pins and trunion caps (not shown), to the second longitudinal end of the base channel 16. The threaded trunion 28 has a threaded annulus or nut (not shown in detail) which moves axially along the length of the drive screw 20 in response to rotation of the drive screw 20. Such movement raises and lowers the load rest relative to the base in a known manner.

In the illustrated embodiment, the base 12 is preferably stamped from sheet metal stock and formed to have first and second upstanding sidewalls for receiving a pivot connection to the base channel 16. The base channel 16 is likewise preferably stamped and formed metal and comprises a bottom wall 30 and first and second sidewalls 32, 34 so as to define a substantial U-shape in cross-section as shown for example in FIG. 5.

Figure 5:
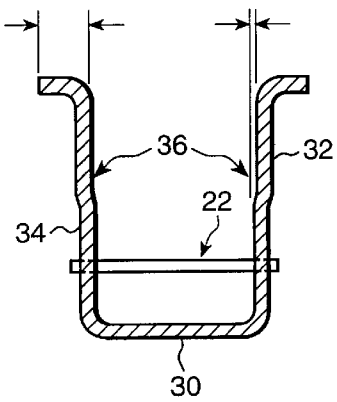
FIG. 5 is a schematic cross sectional view taken along line 5—5 of FIG. 4.
Figure 3:
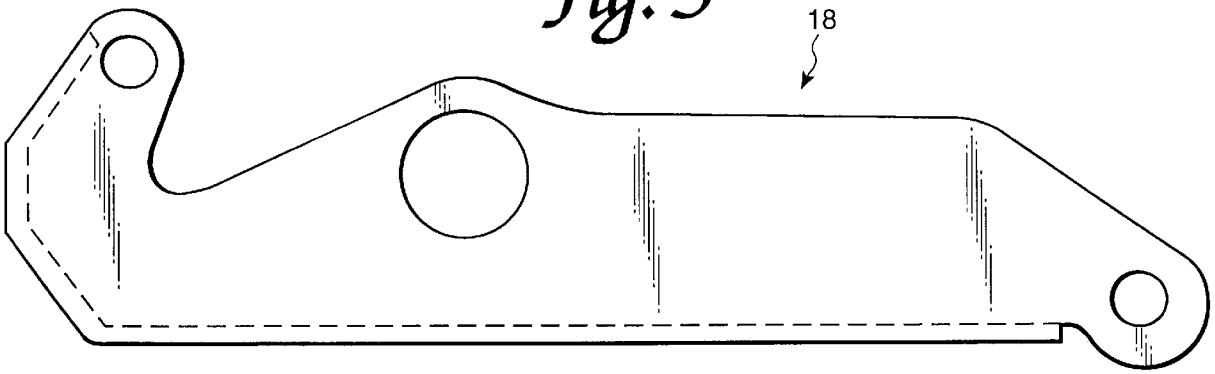
FIG. 3 is a schematic elevational view of a lift channel provided in accordance with the present invention.

In the illustrated embodiment, the longitudinally extending sidewalls of the base channel include a lateral offset portion 36 as can be seen in particular in FIG. 5. The slight lateral offset ensures that structure pivotally coupling the drive screw 20 and the lift channel 18, e.g. the trunion pins and caps, can be received at least partially between the sidewalls 32, 34 of the base channel when the jack is in its lowered configuration (see FIG. 1). In this manner the dimensions of the jack can be minimized. Omission of that offset may limit the complete collapse of the jack but would not materially depart from the advantages of the herein described invention.

Figure 2:
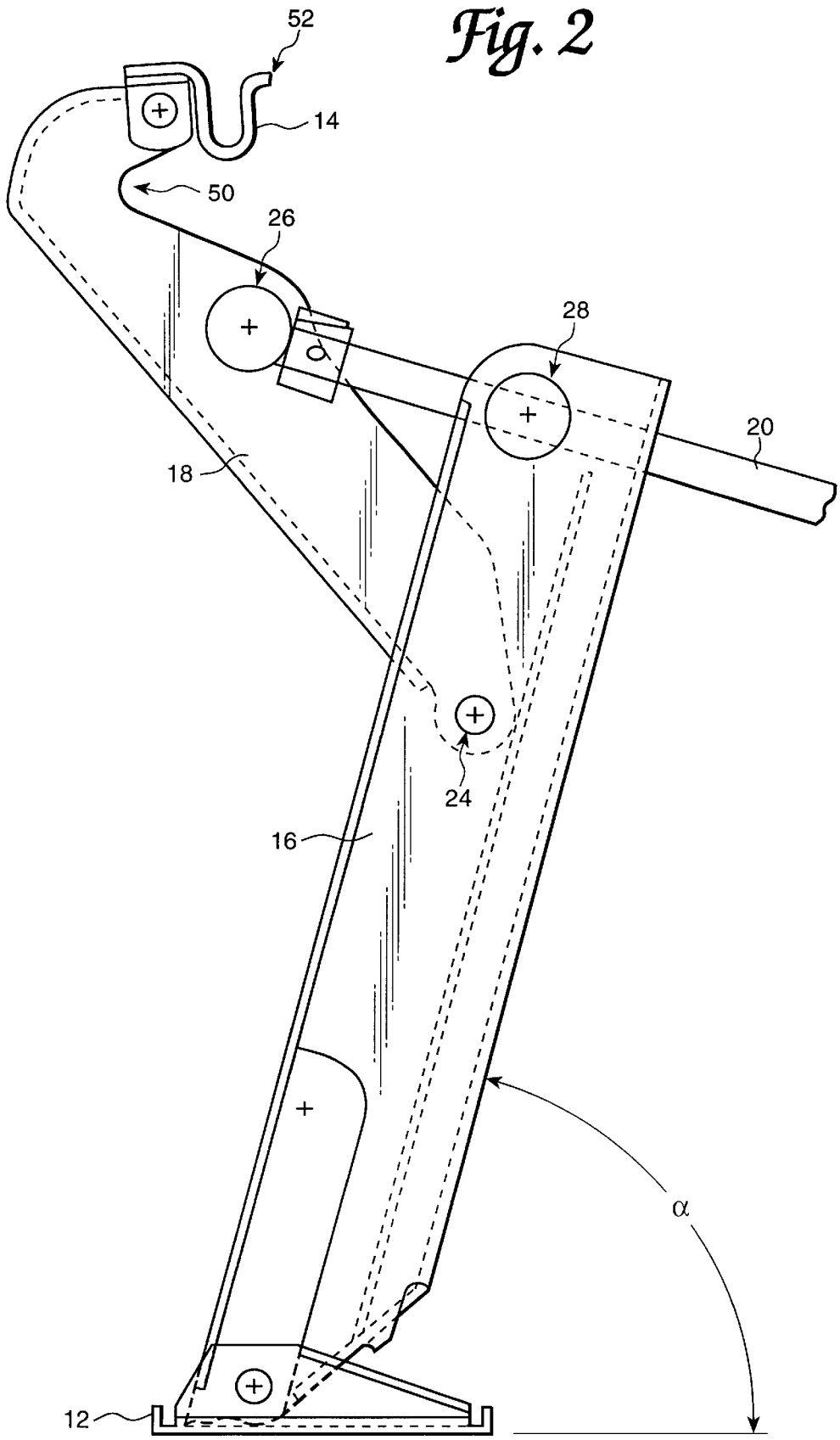
FIG. 2 is a schematic elevational view of a jack provided in accordance with the present invention extended to substantially its maximum height.

In the currently preferred embodiment, a stop surface 38 is defined at the first longitudinal end edge of the side walls of the base channel. More particularly, the longitudinal sidewalls of the base channel preferably terminate adjacent to the pivotal coupling to the base with a stop edge or surface 38, as can be seen in FIG. 1, so that when the jack is in its fully raised height as shown in FIG. 2, the stop edges engage the bottom wall of the base 12 to limit the vertical orientation of the base channel 16. In the configuration illustrated in FIG. 2, the fully extended jack presents a base channel inclined at an angle of about 70° to 85° and most preferably about 80° to the plane of the bottom wall of the base.

In the illustrated embodiment, the material defining the base channel preferably has a thickness on the order of 2.75 to 3.25 mm and, for most applications, most preferably, 2.82–3.18 mm. The particular thickness may of course vary depending upon a variety of factors including the vehicle to be lifted and details of the jack assembly configuration.

A channel bracket 22, 122, 222 is provided in accordance with the present invention to substantially span either the interior of the base channel, as shown in FIGS. 5 and 7, or the exterior of the base channel, as shown in FIG. 9. In the embodiments illustrated in FIGS. 1–8, the channel bracket 22, 122 has a plurality of projections or tabs 40, 42 for being received in respective slots or cutouts 44, 46 in the base channel. Thus, in the embodiment of FIGS. 4–6, slots 44 are defined in the side walls 32, 34 of the base channel 16 for receiving the tabs 40. In the embodiment of FIG. 7, on the other hand, the slots 46 are defined in the bottom wall 30 of the base channel 16. In either event, the provision of tabs and slots and their number and relative location should be understood to be exemplary and embody the currently most preferred configurations but not necessarily limiting.

When the bracket is installed with the tabs extending through the slots in the base channel, the tabs may be welded, folded over, or simply staked to secure the bracket in position. In the configuration of FIG. 9, the bracket 222 is attached via welding or staking. Thus, in the preferred embodiment, the channel bracket is either mechanically fastened to or welded in the base channel. The provision of a channel bracket minimizes the likelihood that the sidewalls 32, 34 of the base channel 16 will be distorted or deformed during use from the preferred U-shaped configuration shown in FIGS. 5, 7, and 9.

In the embodiment of FIGS. 1–6, the channel bracket 22 includes a reduced width portion 48 to accommodate the sidewalls of the lift channel 18 at the pivotal connection 24 of the lift channel to the base channel (see, e.g. FIG. 1). Similarly, although not shown, the channel bracket of FIGS. 7 and 8 may have cutouts or offset portions to accommodate the components of the jack assembly as deemed necessary or desirable in view of their assembled configurations, relative movement, and the overall compactness of the assembly.

Figure 4:
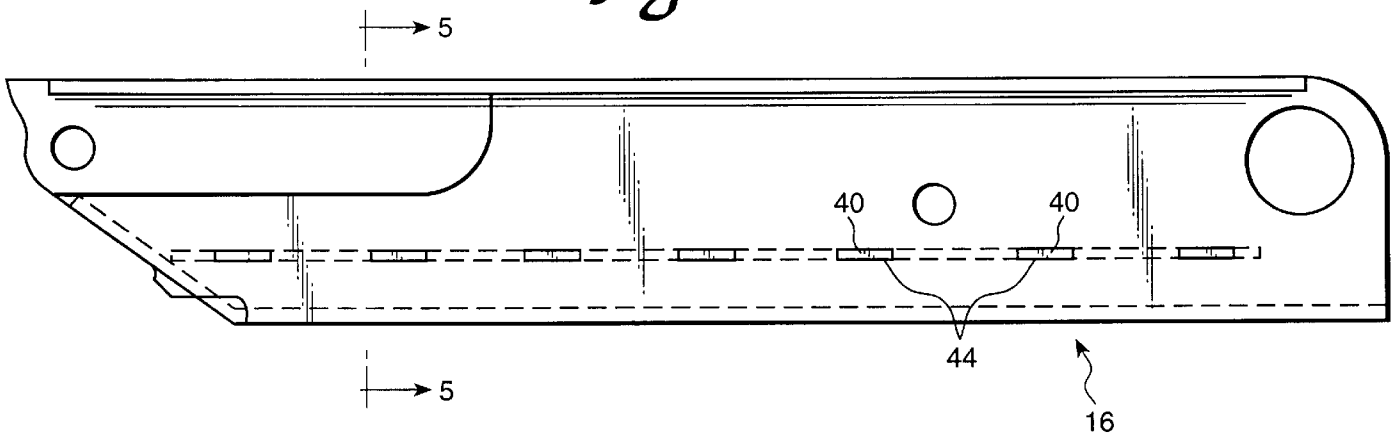
FIG. 4 is a schematic elevational view of a base channel in accordance with one exemplary embodiment of the invention.

In the illustrated embodiment the channel bracket may have a material thickness less than that of the base channel as can be seen in FIG. 4. Thus, in accordance with one embodiment of the invention, the channel bracket may have a thickness on the order of 1.75–2.25 mm and most preferably, for most applications, 1.9 mm.

The lift channel is also formed from sheet stock which has been stamped and formed, preferably to a generally "U"-shaped configuration as illustrated. The lift channel has a material thickness on the order of that for the base channel.

In the illustrated embodiment, the sidewalls of the lift channel extend longitudinally beyond the bottom wall thereof to facilitate the pivot connection of the lift channel to the base channel. As noted above, the projecting sidewall at this joint can be accommodated by a reduced width segment 48, or offset portion of the channel bracket.

Furthermore, to accommodate the load rest 14 in the collapsed configuration (FIG. 1), an arcuate recess or cutout portion 50 is defined in the side walls of the lift channel 18 for receiving the load rest. Likewise the load rest is of truncated length as at 52 to provide for a compact design.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A collapsible half-scissors jack for performing a vehicle raising operation wherein a portion of a motor vehicle is raised out of contact with a ground surface, said jack comprising:

a base constructed and arranged to be engaged with the ground surface during the vehicle raising operation;

a first jack arm having first and second longitudinal ends, the first jack arm being pivotally coupled to the base at the first longitudinal end thereof;

a second jack arm having first and second longitudinal ends, the first longitudinal end of the second jack arm being pivotally coupled to the first jack arm;

a load rest coupled to the second longitudinal end of the second jack arm, said load rest being constructed and arranged to be engaged with the motor vehicle during the vehicle raising operation;

a drive screw operatively coupled to the first and second arms and being constructed and arranged such that, when said base is engaged with the ground surface and the load rest is engaged with the vehicle, rotation of the drive screw relative to the jack arms selectively increases a vertical distance between the load rest and the base so as to raise a portion of the motor vehicle out of contact with the ground surface, thereby performing the aforesaid vehicle raising operation;

the first jack arm being stamped and formed from metal so as to provide said first jack arm with a generally U-shaped cross section with a bottom wall and spaced apart first and second side walls of said first jack arm defining a base channel, said first jack arm being constructed and arranged such that torquing movements of said second jack arm and said load rest relative to said base apply torsional loads to said first jack arm;

said first and second jack arms and said drive screw being constructed and arranged such that said jack can be manipulated into a collapsed storage position wherein said second jack arm is pivoted about the pivotal coupling between said first and second jack arms so as to be received within said base channel between the spaced apart first and second side walls of said first jack arm;

a channel bracket structure secured to the first jack arm, said channel bracket structure being positioned with respect the first and second side walls defining said base channel such that said channel bracket structure permits said second jack arm to be received within said base channel between said first and second side walls when said jack is manipulated into the aforesaid collapsed storage position, said channel bracket structure being constructed and arranged to reinforce said first jack arm and receive a portion of the torsional loads applied to said first jack arm by the torquing movements of said load rest and said second jack arm relative to said base so as to reduce torsional deflections of said first jack arm during the vehicle raising operation.

2. A jack structure as in claim 1, wherein said channel bracket structure is substantially planar and extends between and is coupled to said first and second side walls of said first jack arm.

3. A jack structure as in claim 2, wherein said channel bracket structure has a plurality of tab elements defined along longitudinal side edges thereof, each said tab element being received in a respective slot defined in a said side wall of said base channel.

4. A jack structure as in claim 2, wherein said channel bracket structure is welded to said base channel.

5. A jack structure as in claim 1, wherein said channel bracket structure is welded to said base channel.

6. A jack structure as in claim 1, wherein said channel bracket structure is of inverted U-shape in vertical cross-section and is mounted within said base channel so that a bottom wall thereof extends substantially between the first and second side walls of said base channel and first and second side walls of said channel bracket structure extended generally parallel to said first and second side walls of said base channel, at least between said bottom wall of said channel bracket structure and said bottom wall of said base channel.

7. A jack structure as in claim 6, wherein longitudinal edges of said first and second side walls of said channel bracket structure have a plurality of tabs defined therealong, said bottom wall of said first jack arm having slots defined therein for receiving said tabs of said channel bracket structure.

8. A jack structure as in claim 7, wherein said tabs are folded over so as to secure the channel bracket structure relative to said base channel.

9. A jack structure as in claim 1, wherein said drive screw is pivotally coupled to said first jack arm at said second longitudinal end of said first jack arm and is pivotally coupled to said second jack arm at a point intermediate the longitudinal ends of said second jack arm.

10. A jack structure as in claim 1, wherein said first longitudinal end of said second jack arm is pivotally coupled to said first jack arm at a point intermediate the longitudinal ends of said first jack arm.

11. A jack structure as in claim 6, wherein said channel bracket structure is welded to said base channel.

12. A jack structure as in claim 1, wherein said channel bracket structure is of U-shape in vertical cross-section.

13. A jack structure as in claim 12, wherein said channel bracket structure is mounted within said base channel.

14. A jack structure as in claim 12, wherein said channel bracket structure is mounted to an exterior of said base channel.

15. A jack structure as in claim 12, wherein said channel bracket structure is welded to said base channel.

16. A jack structure as in claim 1, wherein said channel bracket structure is formed independently of said base channel and is mounted thereto after forming.

17. A jack structure as in claim 1, wherein said channel bracket structure extends longitudinally along a substantial portion of a length of said base channel.

18. A jack structure as in claim 1, wherein said channel bracket structure has a base wall, said channel bracket structure being secured to said base channel so that said base wall is disposed substantially in parallel to and adjacent but spaced from the bottom wall of the base channel to define therewith a box section that reduces torsional deflection in the base channel in use.

19. A jack structure as in claim 18, wherein said channel bracket structure extends longitudinally along a substantial portion of a length of said base channel.

20. A jack according to claim 1, wherein said channel bracket structure extends transversely with respect to a longitudinal extent of said base channel a distance equal to at least a substantial portion of a distance between the first and second side walls.

* * * * *